US007658375B2

(12) United States Patent
Wong et al.

(10) Patent No.: US 7,658,375 B2
(45) Date of Patent: Feb. 9, 2010

(54) PRINTER AND DUAL TRAYS FOR IMAGE RECEIVER MEDIA SHEETS

(75) Inventors: Randal M. Wong, Singapore (SG); Juan Belon, San Diego, CA (US); Petrica D. Balcan, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 35 days.

(21) Appl. No.: 11/969,258

(22) Filed: Jan. 4, 2008

(65) Prior Publication Data

US 2009/0174134 A1 Jul. 9, 2009

(51) Int. Cl.
*B65H 1/22* (2006.01)

(52) U.S. Cl. ..... 271/164; 271/9.12

(58) Field of Classification Search ..... 271/164, 271/9.12

See application file for complete search history.

(56) References Cited

U.S. PATENT DOCUMENTS 4,998,714 A * 3/1991 Sparer et al. ..... 271/117
5,033,891 A * 7/1991 Kitazume et al. ..... 400/624
5,044,620 A * 9/1991 Ruch et al. ..... 271/9.08
5,069,434 A * 12/1991 Sellers ..... 271/2
5,076,562 A * 12/1991 Sai et al. ..... 271/9.08
5,182,595 A * 1/1993 Fukuchi et al. ..... 399/21
5,195,734 A * 3/1993 Tanabe ..... 271/9.03
5,335,903 A * 8/1994 Martin et al. ..... 271/157
5,364,088 A * 11/1994 Maruyama et al. ..... 271/164
5,374,046 A * 12/1994 Toki et al. ..... 271/9.01
5,443,252 A * 8/1995 Morinaga et al. ..... 271/127
5,897,110 A * 4/1999 Fujiwara ..... 271/4.01
6,244,588 B1 * 6/2001 Tsubakimoto et al. ..... 271/164
2003/0025263 A1 * 2/2003 Koga ..... 271/9.12
2006/0262355 A1 * 11/2006 Kurata et al. ..... 358/305

FOREIGN PATENT DOCUMENTS

JP 06183586 A * 7/1994
WO 2006/130349 12/2006

* cited by examiner

*Primary Examiner*—Patrick H Mackey
*Assistant Examiner*—Prasad V Gokhale
(74) *Attorney, Agent, or Firm*—William R. Zimmerli; David A. Novais

(57) ABSTRACT

A printer having a sheet tray, a drive for advancing sheets past a marking mechanism, and a picker to remove sheets from an aligned tray includes a load position and a pick position. The trays are selectively moved between the load and pick positions. A transmission is engagable to connect the drive to the tray moving mechanism, whereby the tray is moved between the pick position and the load position by the media sheet advancing drive. The transmission is disengagable to enable advancement of the media sheets without movement of the tray. Starting with both trays in their load positions, one of the trays is moved to its pick position whereat a sheet can be picked; moving the other of the trays to its pick position whereat a sheet of media from each of the trays can be picked; and moving the tray remaining at its pick position from its pick position to its media load position.

8 Claims, 13 Drawing Sheets

PRINTER AND DUAL TRAYS FOR IMAGE RECEIVER MEDIA SHEETS

FIELD OF THE INVENTION

The present invention relates to home and office printers, and more specifically to improvements in image receiver media trays and the interface between such trays and the printer.

BACKGROUND OF THE INVENTION

Home and office printers that have trays into which image receiver material sheets can be loaded and fed to a print station are well known. Such trays are usually adapted to receive several standard-sized sheets of image receiver media, such as letter (8.5"×11" or 215.9×279.4 mm), A4 (210.0×297.0 mm), and legal (8.5"×14" or 215.9×355.6 mm).

Often, the printers are capable of producing photo-quality prints on smaller sheets of image receiver media, such as 4"×6" (101.6×152.4 mm) that require no more than one-half of the width of the media path through the printer. Of course these smaller sheets of image receiver media do not necessarily need to be of photo-quality material, and can be card stock, labels, or even plain paper. For convenience, the phrases "auxiliary media" and "auxiliary tray" will be used to designate any image receiver media that require no more than one-half of the width of the media path through the printer and any tray that is adapted to receive such photo media, respectively. Commercially available auxiliary trays have only a single tray and are manual in the sense that the user, after loading the tray with auxiliary media, must physically push the auxiliary tray into a position which allows the media to be picked.

Since auxiliary media sheets require no more than one-half of the width of the media path through the printer, it would be convenient to provide side by side stacks of such media sheets so that two sheets, one from one stack and the other from the other stack, can be picked simultaneously and fed through the printer at the same time. This would provide higher throughput, since two sheets can be printed simultaneously. By printing on two sheets side by side, the number of times per sheet that the carriage must be turned around to print a new swath is cut in half. This reduction in turnaround times is one factor leading to higher throughput. Another factor is the faster paper loading and ejecting of two sheets at a time. Further, it would provide additional flexibility if only a single sheet could be picked and fed through the printer so that an odd number of sheets could be printed without the requirement of feeding an extra, blank sheet through the printer.

SUMMARY OF THE INVENTION

According to a feature of the present invention, a printer having a tray for receiver media sheets, a sheet drive for advancing media sheets past a marking mechanism, and a picker to remove media sheets from an aligned tray includes a media load position at which the tray is accessible for inserting a supply of media sheets and a media pick position at which the tray is aligned with the picker. A tray moving mechanism selectively moves the tray between the media load and pick positions. A transmission is engagable to connect the drive of the sheet feeding mechanism to the tray moving mechanism, whereby the tray is moved between the pick position and the media load position by the media sheet advancing drive. The transmission is disengagable to enable advancement of the media sheets without movement of the tray.

According to another feature of the present invention, the printer includes first and second trays. The printer has a media load position and a media pick position for each of the trays. The trays are aligned side by side when both are at their pick positions, such that the picker can simultaneously remove a sheet from each tray.

In a preferred embodiment, the mechanism for moving each tray is connectable independently to each tray so as to move one tray at a time from its media load position to its pick position such that the picker: can remove a sheet from the first tray at the pick position before the second tray reaches the pick position, and can remove a sheet from the tray remaining at the pick position after the other tray has been moved from the pick position.

According to yet another feature of the present invention, a method of producing a single print using a printer that has two media trays, a media load position for each tray, and a pick position for each tray includes the steps of starting with both trays in their media load positions, moving one of the trays to its pick position; picking a sheet of media from the one tray; moving the other of the trays to its pick position; and moving both trays from their pick positions to their media load positions without picking additional sheets of media.

According to still another feature of the present invention, a method of producing an even number of prints includes the steps of starting with both trays in their media load positions, moving one of the trays to its pick position; moving the other of the trays to its pick position; picking a sheet of media from each of the trays; and moving both trays from their pick positions to their media load positions without picking additional sheets of media.

According to yet another feature of the present invention, a method of producing an odd number of prints includes the steps of starting with both trays in their media load positions, moving one of the trays to its pick position; moving the other of the trays to its pick position; picking a sheet of media from each of the trays; moving one of the trays to its media load position; picking a sheet of media from the tray remaining at its pick position; and moving the tray remaining at its pick position from its pick position to its media load position.

DETAILED DESCRIPTION OF THE INVENTION

Figure 1:
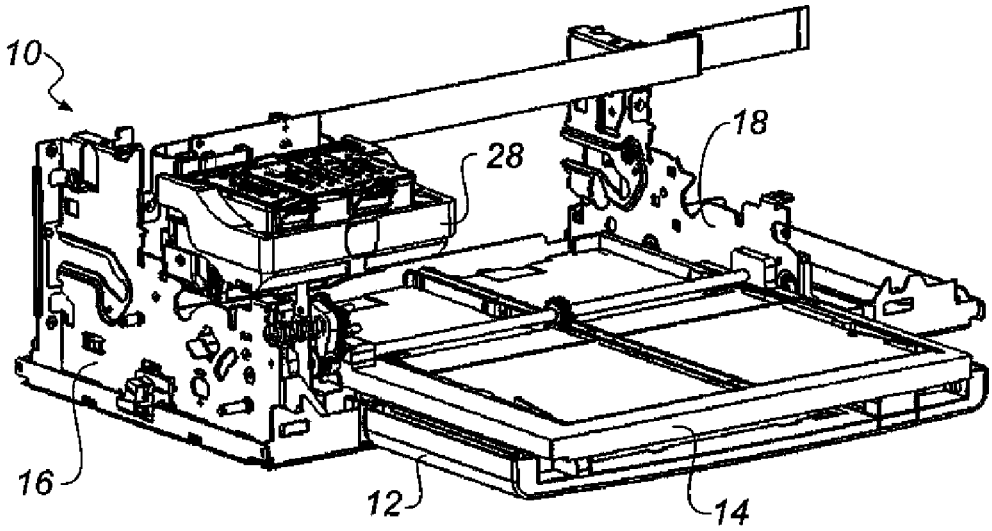
FIG. 1 is a front perspective view of a portion of a printer and media trays according to the present invention.

FIG. 1 is a front perspective view of a portion of a printer 10 and image receiver main tray 12 and an auxiliary tray 14 according to a preferred embodiment of the present invention. The printer housing has been removed for a clearer rendering of the interior of the printer. Main media tray 12 is adapted to receive media sheets of standard sizes, such as letter (8.5"×11" or 215.9×279.4 mm), A4 (210.0×297.0 mm), and legal (8.5"×14" or 215.9×355.6 mm). A slot is provided in the printer for insertion of media auxiliary tray 14. The auxiliary tray is located through holes in the left and right lateral sidewalls 16 and 18, respectively, and it rests on the top of main tray 12.

Figure 2:
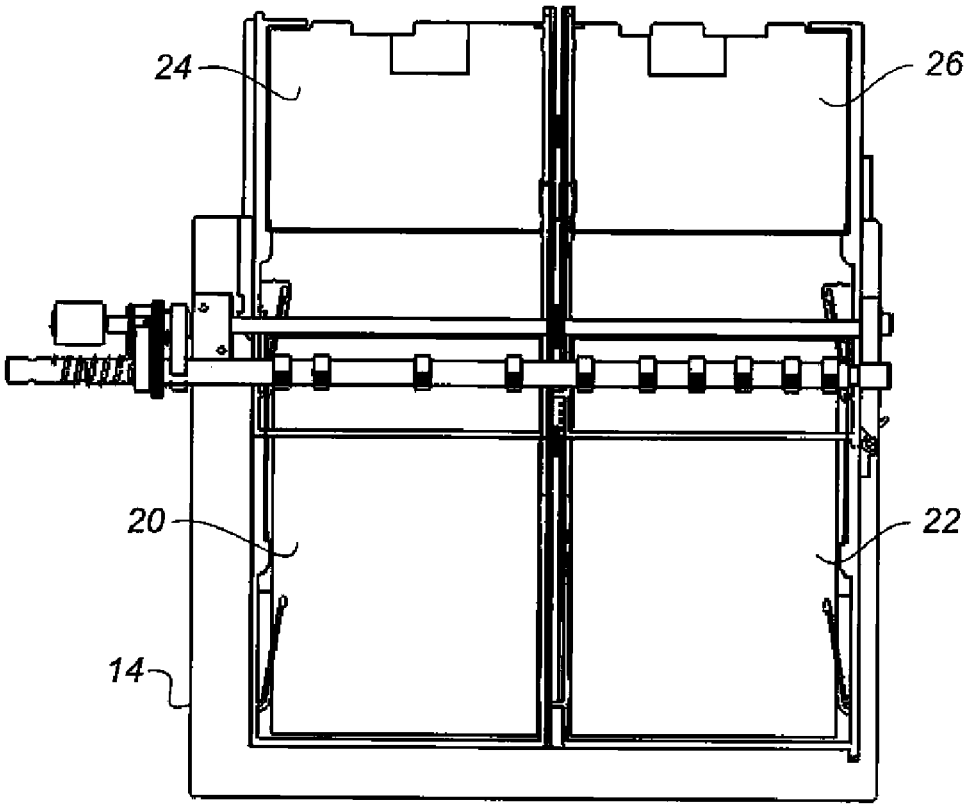
FIG. 2 is a top plan view of the auxiliary media tray of FIG. 1.

As illustrated in FIG. 2, auxiliary tray 14 holds two side by side stacks 20 and 22 of media, such as for example 4"×6" photo media. The two media stacks are loaded in left and right sub-trays 24 and 26, respectively. As used herein, the terms "left" and "right" and "top" and "bottom" are intended to designate elements as viewed in the drawings, and are not indicative of any specific intended orientation of printer 10 during use.

Figure 3:
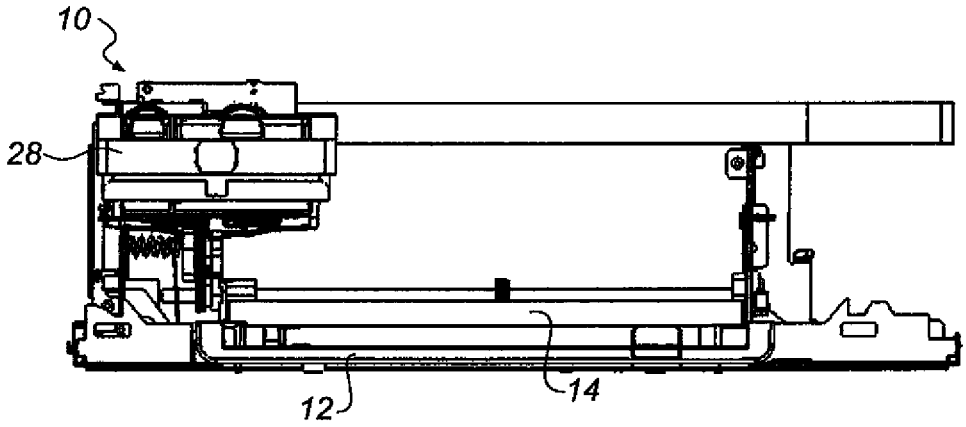
FIG. 3 is a front view of the printer and media trays of FIG. 1.
Figure 4:
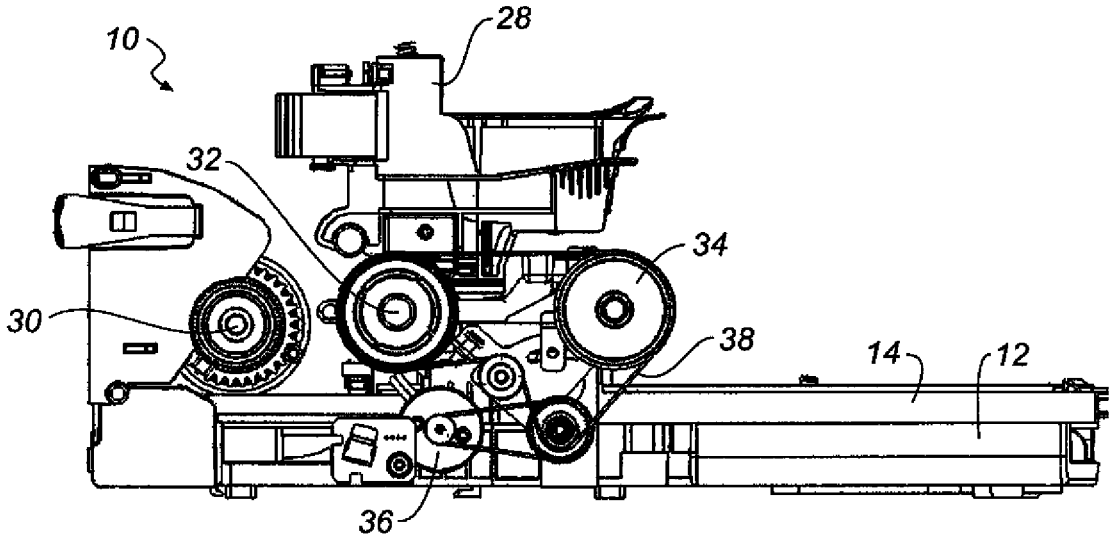
FIG. 4 is a side view of the printer and media trays of FIG. 1.

FIGS. 3 and 4 are front and side views of printer 10 and illustrate main tray 12 and auxiliary tray 14. A carriage 28 carries a print head and a plurality of ink cartridges back and forth across the media path to produce images as is well known in the field.

Figure 5:
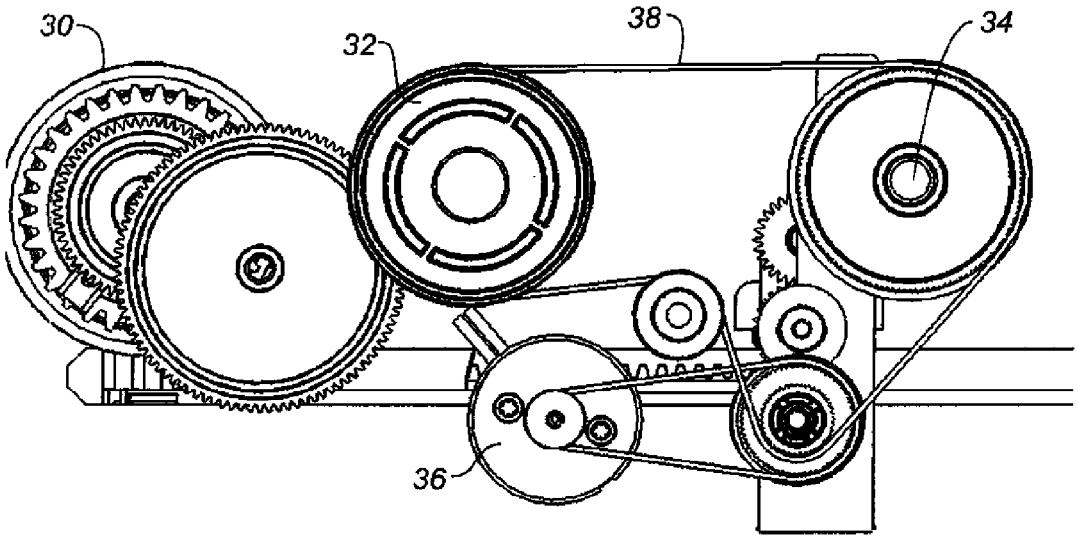
FIG. 5 is a side elevation view of a portion of the printer of FIG. 1 showing details of the media sheet feeding mechanism.

Media sheets, whether from main tray 12 or auxiliary tray 14, are "picked" by the printer. The illustrated embodiment includes a turn roller type pick system, but a person skilled in the art would understand that there are many known pick systems, such as a pick arm type system, that could be employed with only minor modification to the printer and trays. The media sheets move from a tray or trays to a turn roller 30, to a feed roller 32, and finally to an output roller 34. Referring to FIG. 5, a linefeed motor 36 and a timing belt 38 power the movement of output roller 34, feed roller 32 and turn roller 30. When the media sheets within auxiliary tray 14 are directly below turn roller 30, lift plates on the auxiliary tray are raised to push the media sheets in the tray upwards until the top most sheet presses against the turn roller. The turn roller rotation will then transport that media sheet from the auxiliary tray to feed roller 32. A lift plate in the main tray pushing up against the auxiliary tray lift plates raises the lift plates of the auxiliary tray. The main tray lift plate is in turn pushed up by means of a conventional cam mechanism (not shown) in the printer. If there is paper in the main tray, the paper will transfer the force from the main tray lift plates to the auxiliary lift plates. Optionally, the back of the auxiliary lift plates each have a leaf spring (not shown) attached, so that if the two auxiliary trays contain different amounts of media, the leaf springs will accommodate the different stack heights and push the media to the proper height for pick up.

Figure 6:
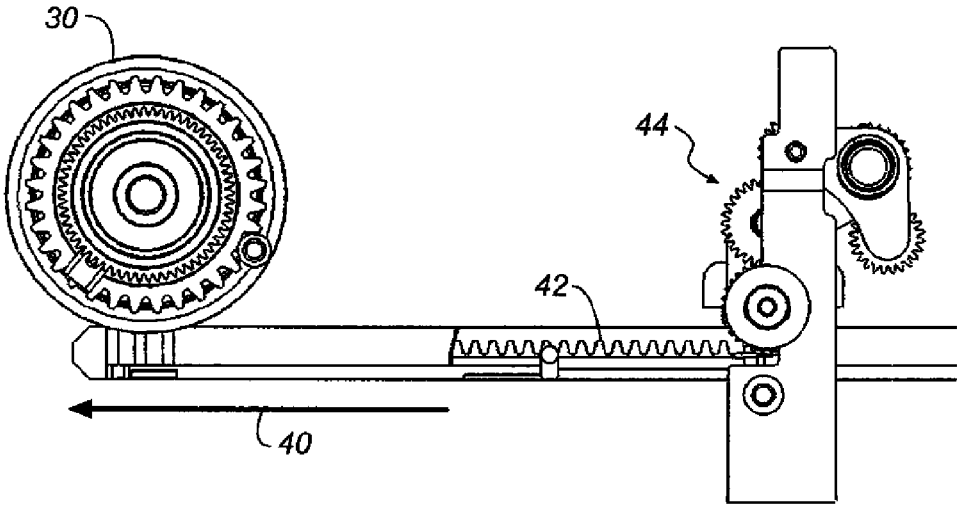
FIG. 6 is a side elevation view similar to FIG. 5 with parts removed for a clearer view of details otherwise hidden.
Figure 7:
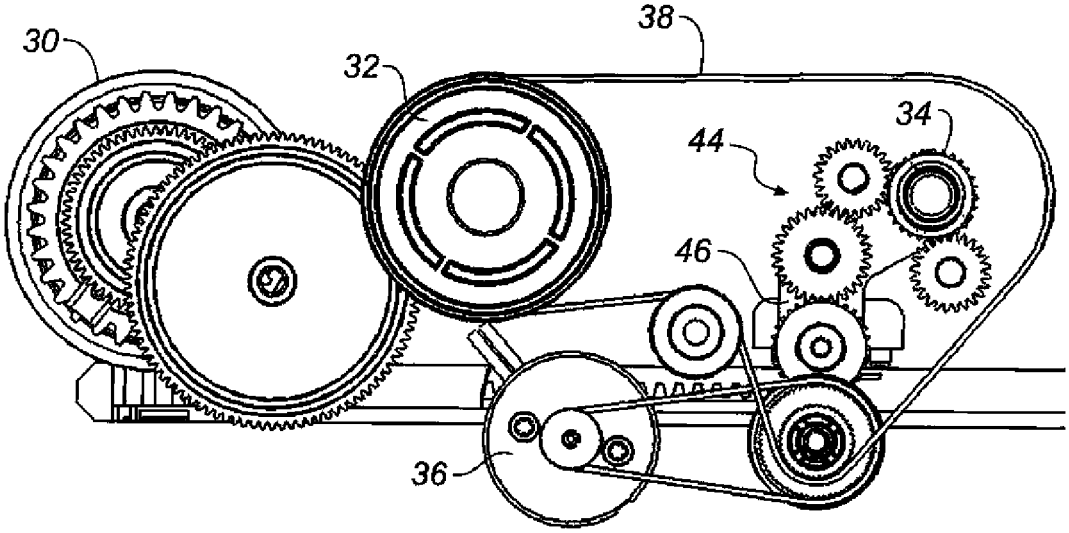
FIG. 7 is a side elevation view similar to FIG. 5 with parts removed for a clearer view of details otherwise hidden.
Figure 8:
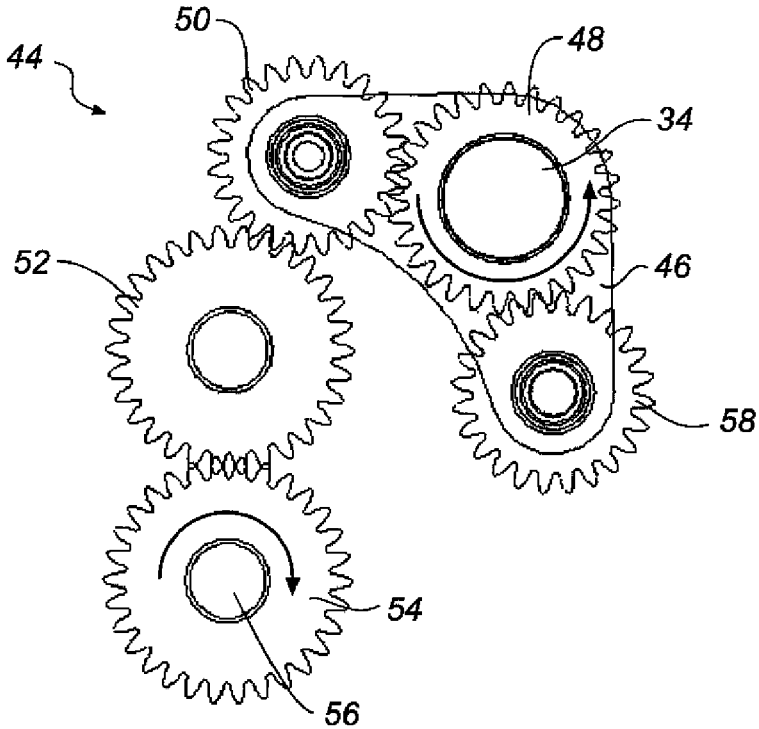
FIGS. 8-10 are views of a rocker gear transmission in various states.
Figure 9:
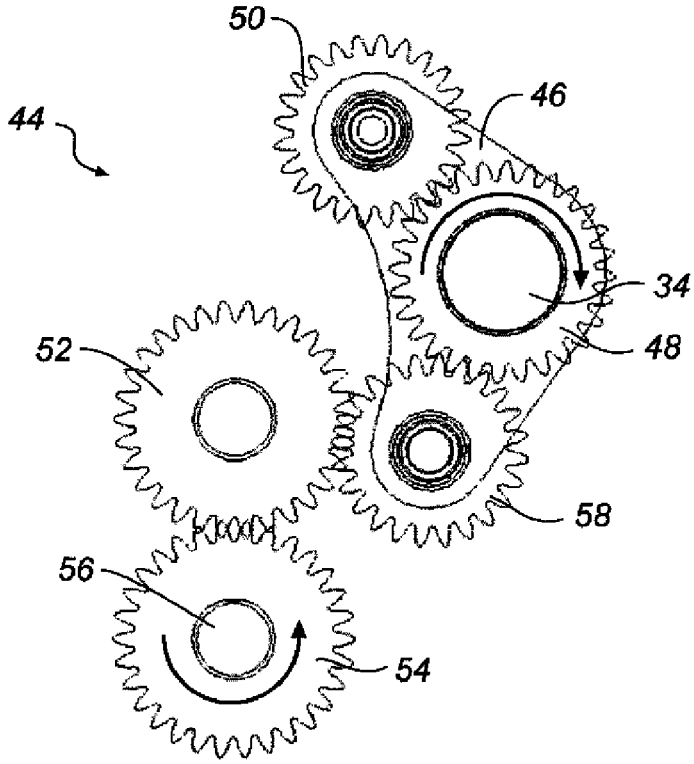

In order for media to be fed from auxiliary tray 14 to turn roller 30, the auxiliary tray must move horizontally towards the turn roller, in the direction of arrow 40 of FIG. 6, until the media is directly below the turn roller. Auxiliary tray 14 (shown in FIG. 4) derives its motion from linefeed motor 36 through a rack 42 and a rocker gear transmission 44, and does not require a separate motor. As such this system is a low cost method that achieves the advantages of the automatic tray. Rocker gear transmission 44 selectively attaches rack 42 to output roller 34. When rocker gear transmission 44 is engaged, as explained below, the rotation of the output roller will drive the photo tray motion due to a nominal gripping friction force between rocker arm 46 and the output roller. Referring to FIG. 7, the rocker gear transmission includes a rocker arm 46 that is free to rotate co-axially with output roller 34. There are three states for the rocker arm 46. A "forwards" state is illustrated in FIG. 8 wherein the auxiliary tray is moved inwardly of the printer to the pick position via an output roller gear 48, a transmission gear 50, an idler gear 52, a gear 54 that is fixed to a gear shaft 56, and rack 42 of FIG. 6. Rocker arm 46 has a "backwards" state is illustrated in FIG. 9 wherein the auxiliary tray is moved outwardly of the printer to a media load position via output roller gear 48, a transmission gear 58, idler gear 52, gear 54 fixed to a gear shaft 56, and rack 42 (shown in FIG. 6). Finally, rocker gear transmission 44 has a "disengaged" state as illustrated in FIG. 10, wherein line feed motor 36 may move media for printing while the auxiliary tray remains stationary.

Figure 10:
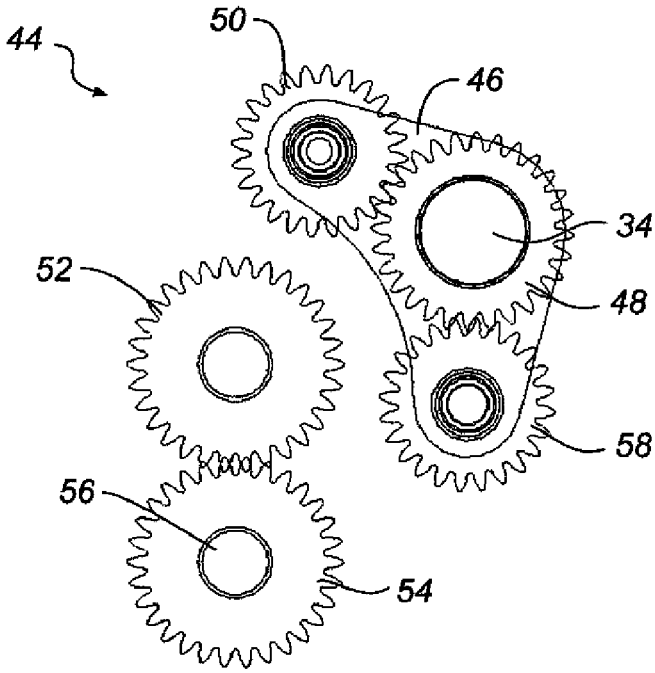
Figure 11:
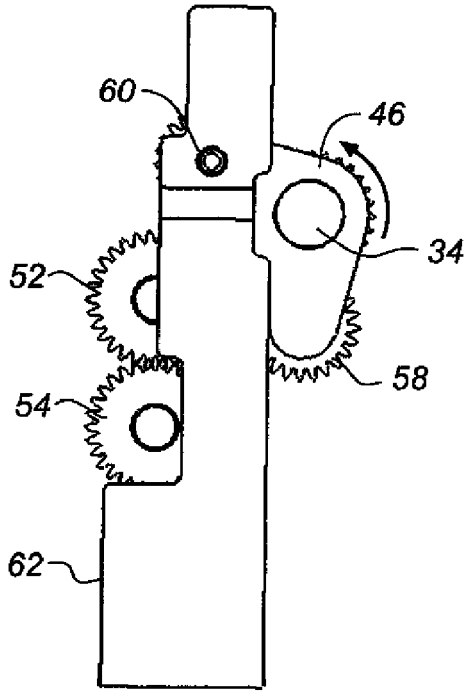
FIG. 11 is a view of the rocker gear transmission and a leaf spring.

As illustrated in FIG. 11, rocker arm 46 is normally held in its disengaged, FIG. 10 state by a pin 60 on the rocker arm. The pin aligns with a hole through a leaf spring 62 to prevent rotation of the rocker arm with output roller 34. In this neutral state of rocker gear transmission 44, there is no transmission of power from linefeed motor 36 to the auxiliary tray 14.

Figure 12:
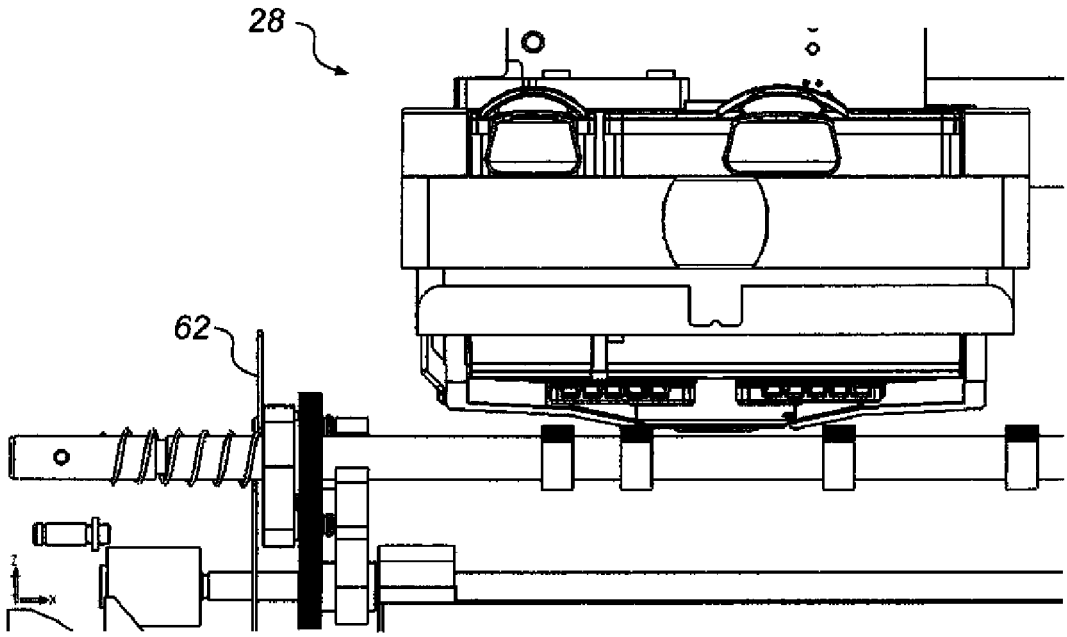
FIGS. 12 and 13 show different states of a leaf spring engagement mechanism.
Figure 13:
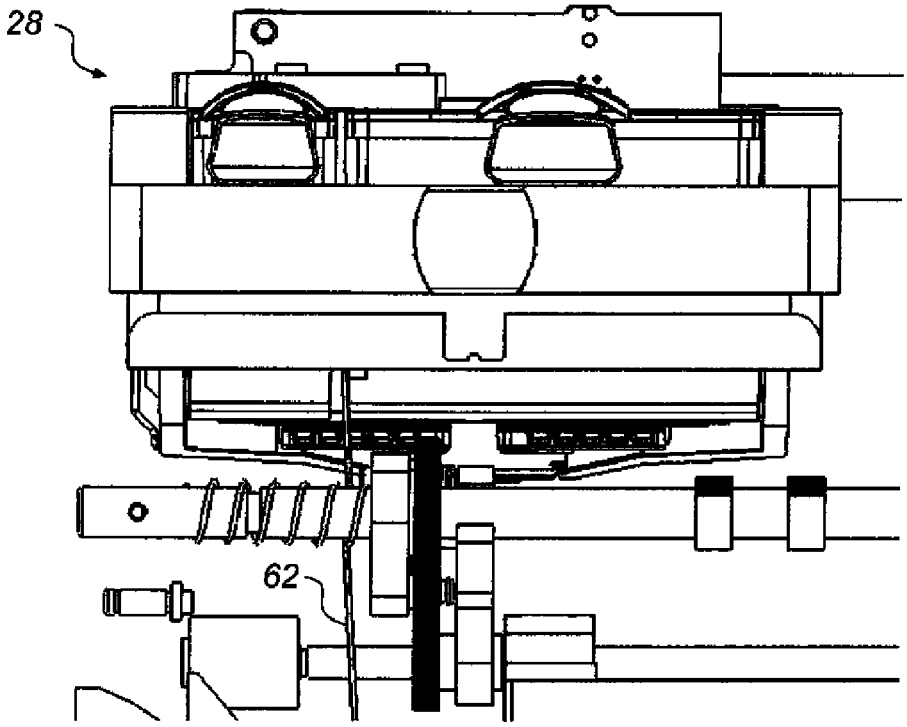

As set forth above, pin 60 on rocker arm 46 must disengage from the hole in leaf spring 62 before rocker gear transmission can effect movement of either sub tray 24 or 26 of auxiliary tray 14. Movement of the leaf spring effects such disengagement so that pin 60 is no longer captured in the hole of the leaf spring. During printing, carriage 28 moves left and right (as viewed in FIG. 12) across the media. However, when a sub tray is to be moved, carriage 28 travels to an extreme left position, "stand-by" position illustrated in FIG. 13, whereby the carriage bumps against leaf spring 62, causing the leaf spring to deflect to the left. This deflection frees pin 60 from the leaf spring and allows the rocker arm 46 to move from its disengaged state. Pin 60 continues to keep the leaf spring 62 in deflection until the pin is returned to the hole, as described below. The carriage is free to move off once it frees the rocker from the leaf spring, allowing the carriage to perform other functions if appropriate. Thus the leaf spring serves as an engagement/disengagement mechanism for the rocker gear transmission.

Figure 14:
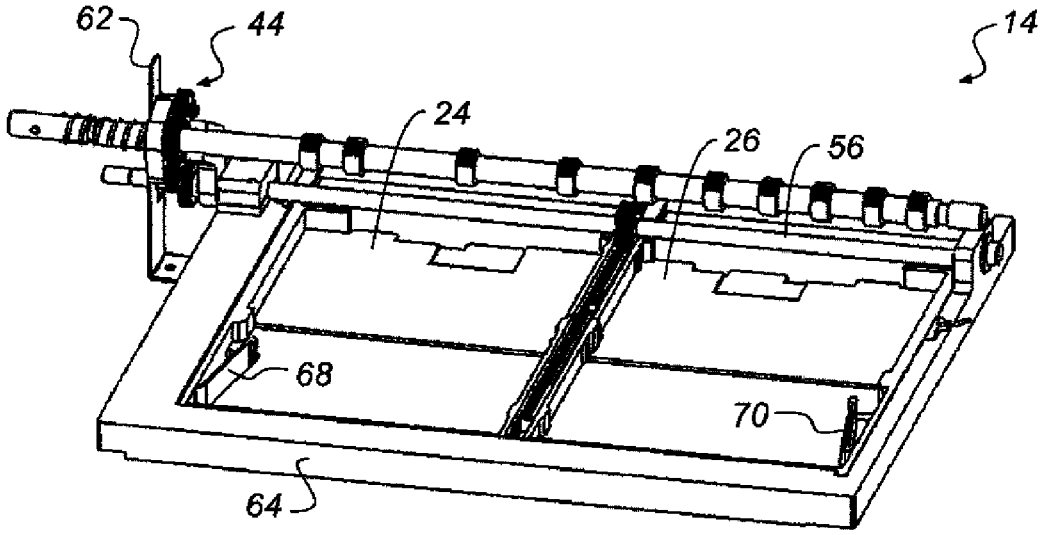
FIGS. 14-25 show a dual tray in various states of operation.
Figure 15:
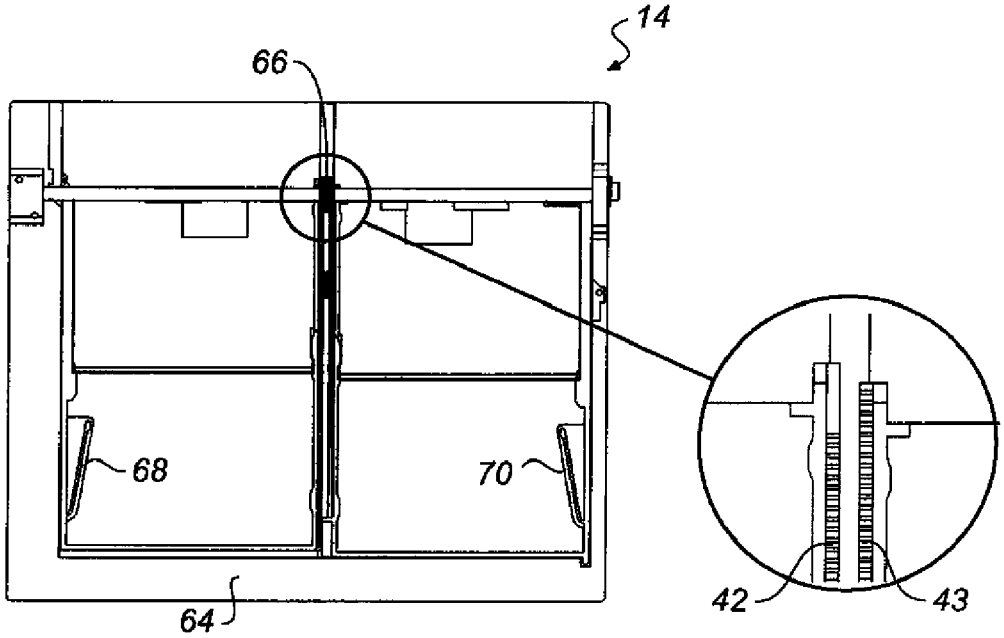

Referring to FIG. 14, auxiliary tray 14 includes a fixed tray support 64, left & right movable sub trays 24 and 26, respectively, rocker gear transmission 44, leaf spring 62 for carriage activation, gear shaft 56 from rocker gear transmission 44, a pinion gear engaging rack 42, and left and right tray biasing springs 68 and 70, respectively. Gear shaft 56 is connected to gear 54 of rocker gear transmission 44 of FIG. 8. Gear shaft 56 rotates as one with pinion gear 66. In turn, rotation of pinion gear 66 translates to linear motion of sub trays 24 and 26 via racks 42 and 43 on the trays as illustrated in FIG. 15. Although the illustrated embodiment provides all of these elements as part of the assembly of auxiliary tray 14, a person skilled in the art would understand that many of the elements could be incorporated into the printer housing and not be removable with the auxiliary tray. In this manner, several lower priced trays, or simpler trays could be used.

Figure 16:
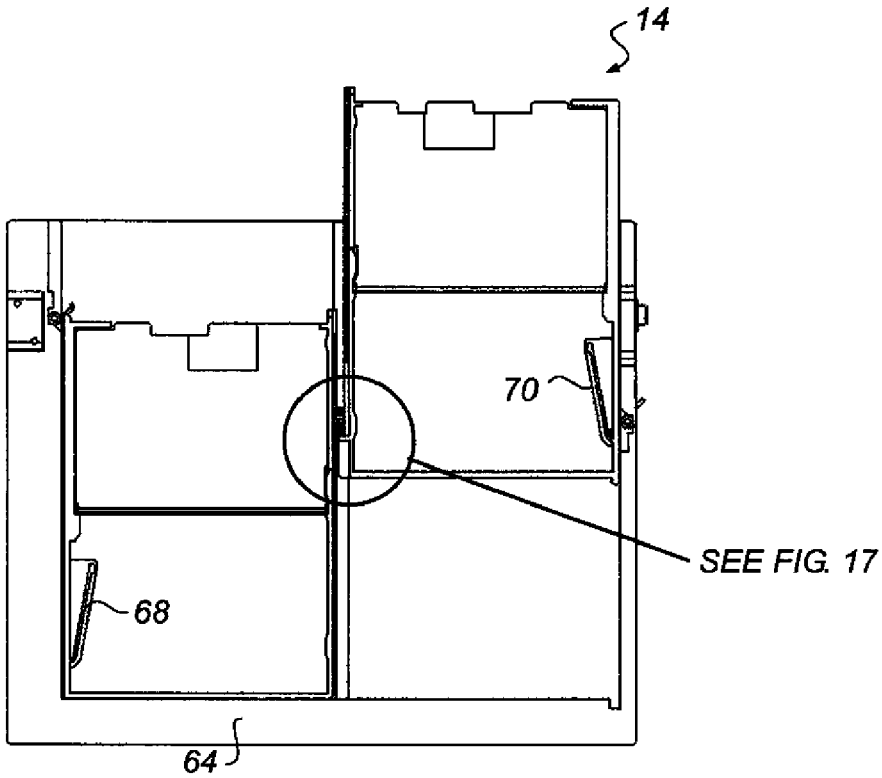

Sub-trays 24 and 26 can move independently of each other, allowing media from either one or both stacks to be "picked" by the printer. In FIG. 15, both of the sub trays are removed from their pick positions, allowing media to be fed from main tray 12 and allowing an operator to load media into the sub trays. Pinion gear 66 is engaged with rack 43. However, rack 42 is slightly shorter than sub tray 24 and is not engaged with pinion gear 66. As the pinion gear rotates, right sub tray 26 moves to its pick position illustrated in FIG. 16.

Figure 17:
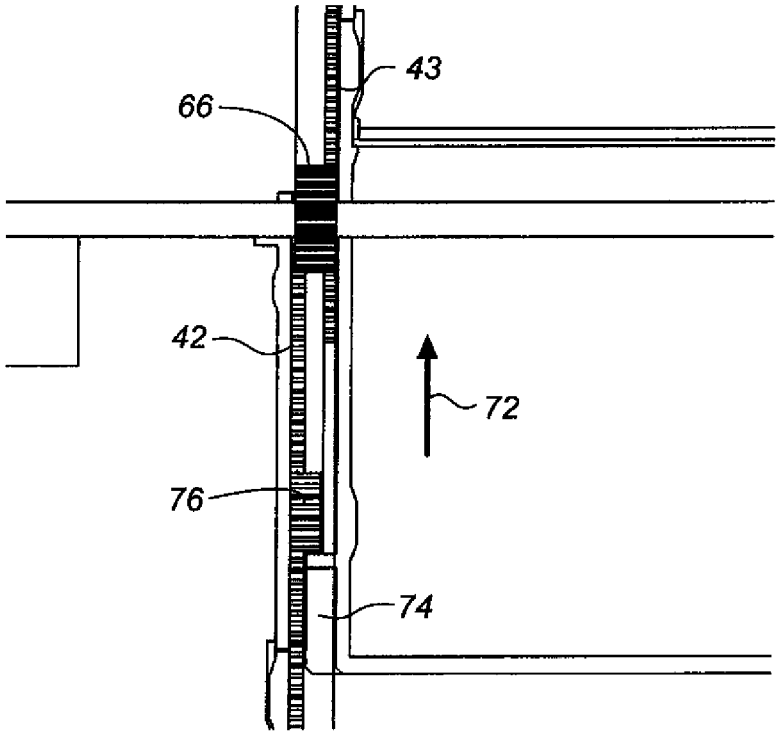
Figure 18:
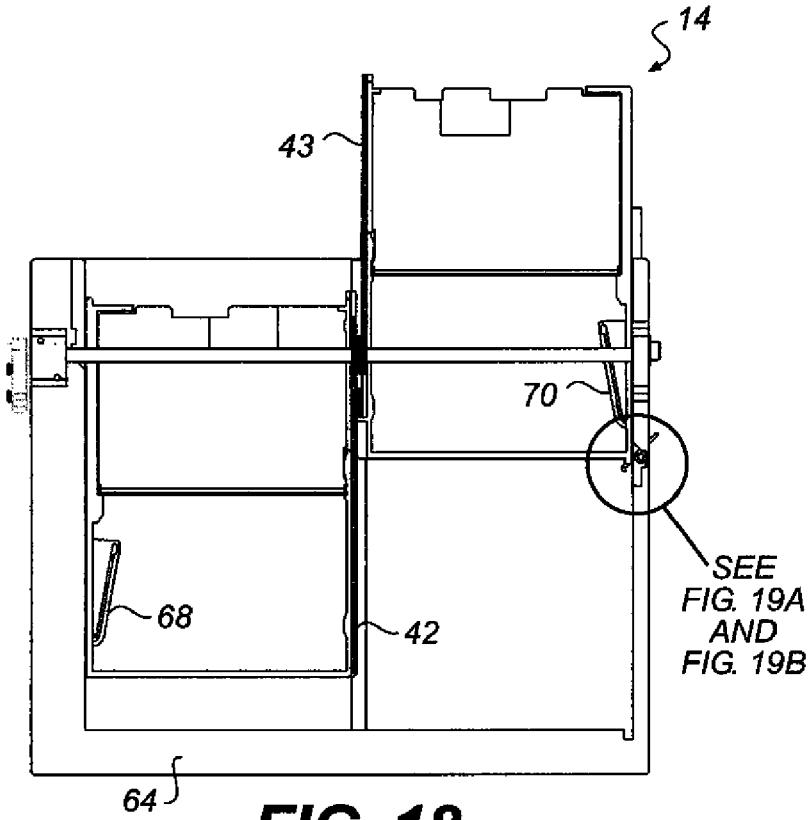

Referring to FIG. 17, as right sub tray 26, traveling in the direction of arrow 72 nears its pick position, an overlap tab feature 74 on the right sub tray engages a corresponding overlap tab feature 76 on left sub tray 24, pushing the left sub tray a few millimeters to engage rack 42 with pinion gear 66 as shown in FIG. 18.

Figure 19A:
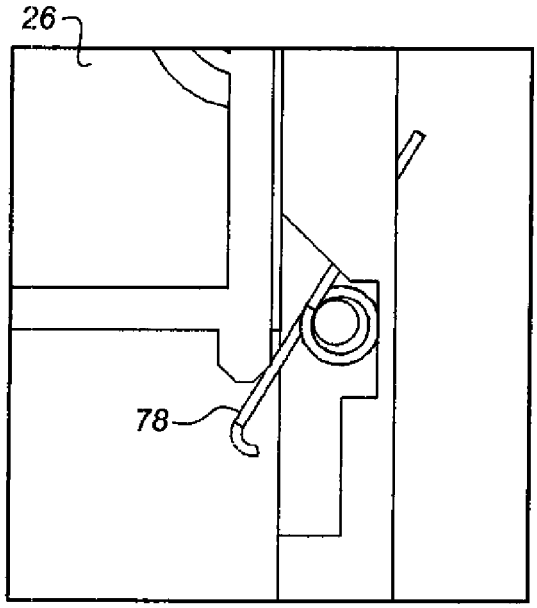
Figure 19B:
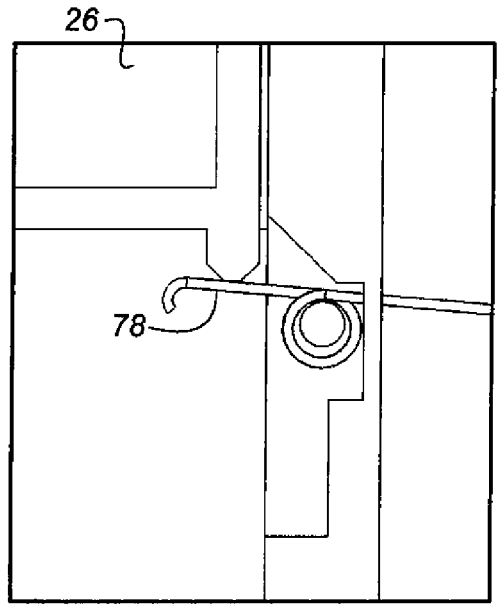
Figure 20:
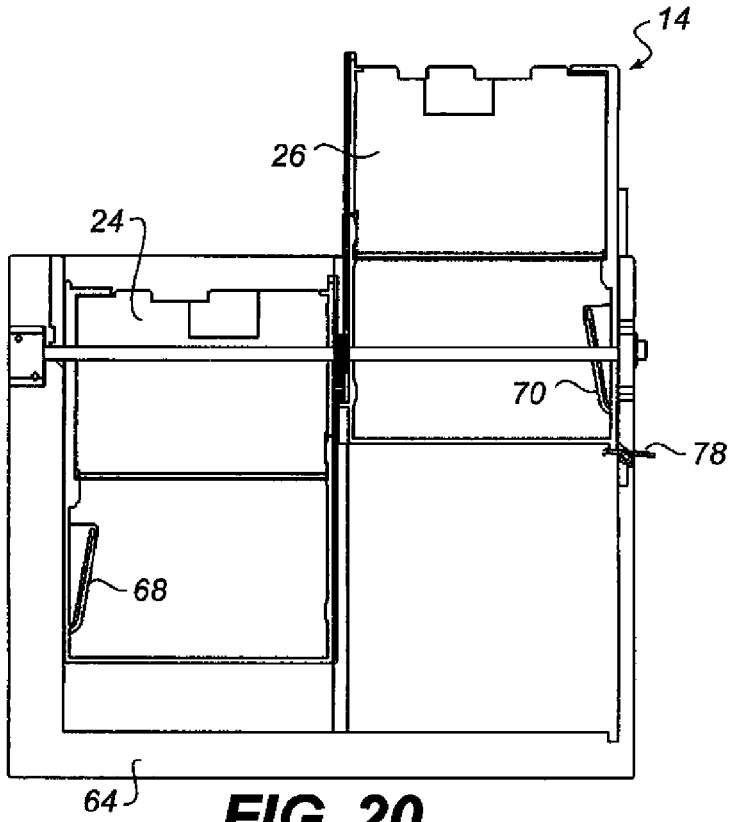
Figure 21:
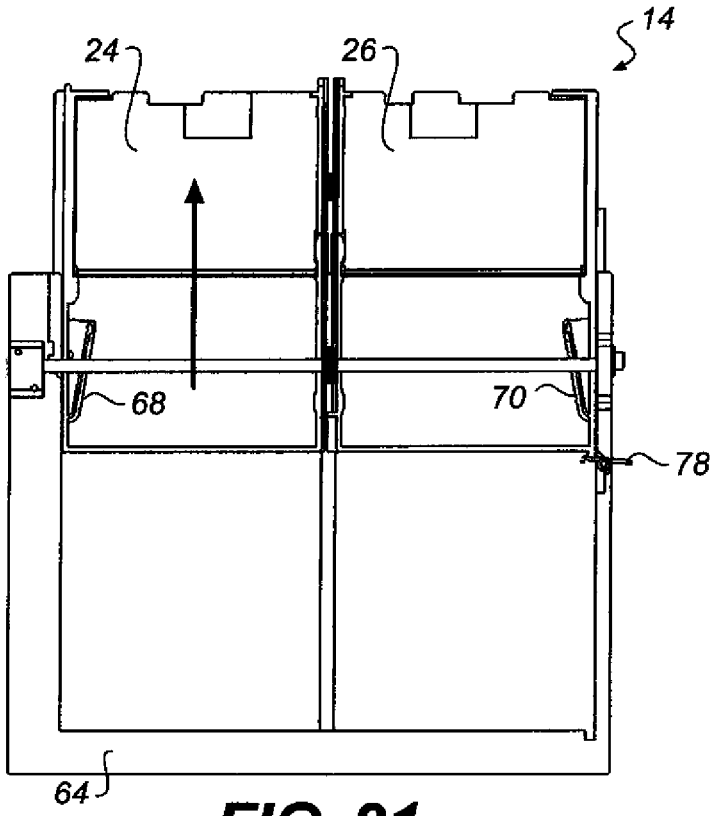

At this position, rack 43 of right sub tray 26 starts to disengage from pinion gear 66. A biasing spring 78 pushes right sub tray 26 an additional few millimeters beyond the end of the rack as sequentially illustrated in FIGS. 19A and 19B until the right sub tray reaches its final pick position shown in FIG. 20. At this stage, the printer may move rocker arm 46 to its FIG. 10 position to disengage transmission 44 by rotating the output roller gear 48 in the opposite direction a distance equal to or greater than the distance required to reseat pin 60 on the rocker arm 46 into the hole on the leaf spring 62. Then the printer picks a media sheet from right sub tray 26, and produces one print. If rocker arm transmission 44 is left engaged, left sub tray 24 continues to move, now driven by pinion gear 66 until the left sub tray also reaches its pick position as illustrated in FIG. 21. Now, both trays are positioned ready to have the media therein picked for an even number of prints.

Figure 22:
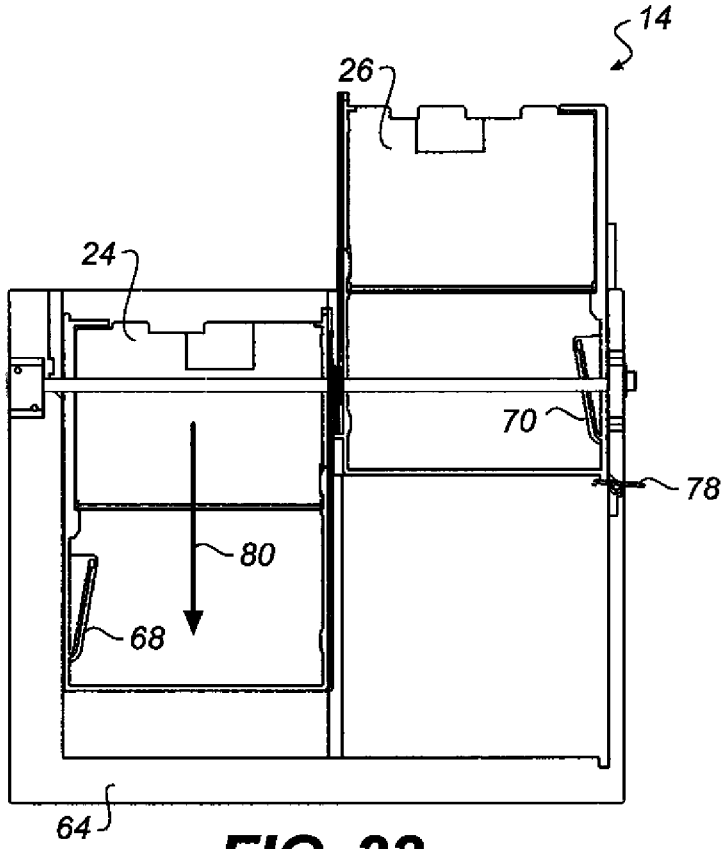
Figure 23:
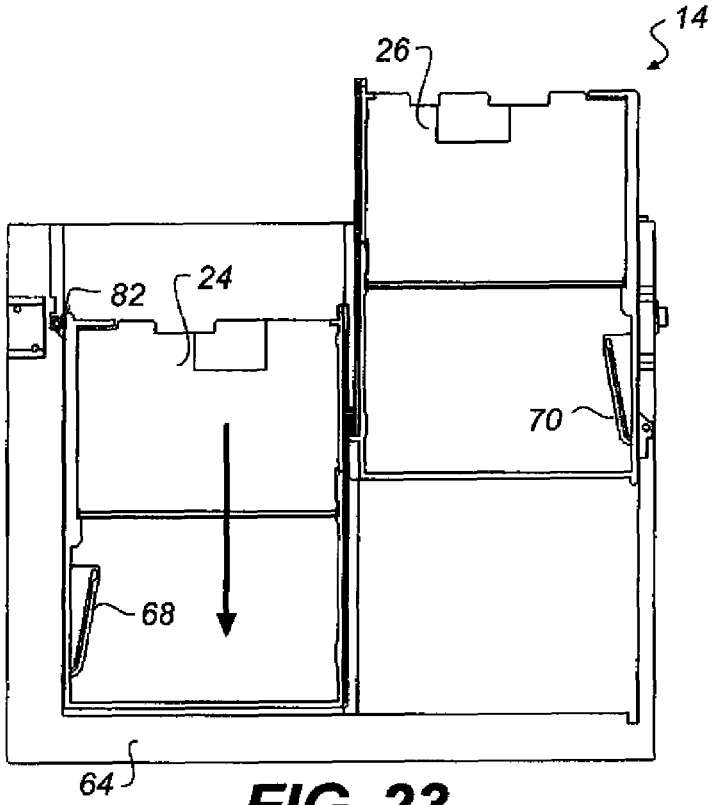
Figure 24:
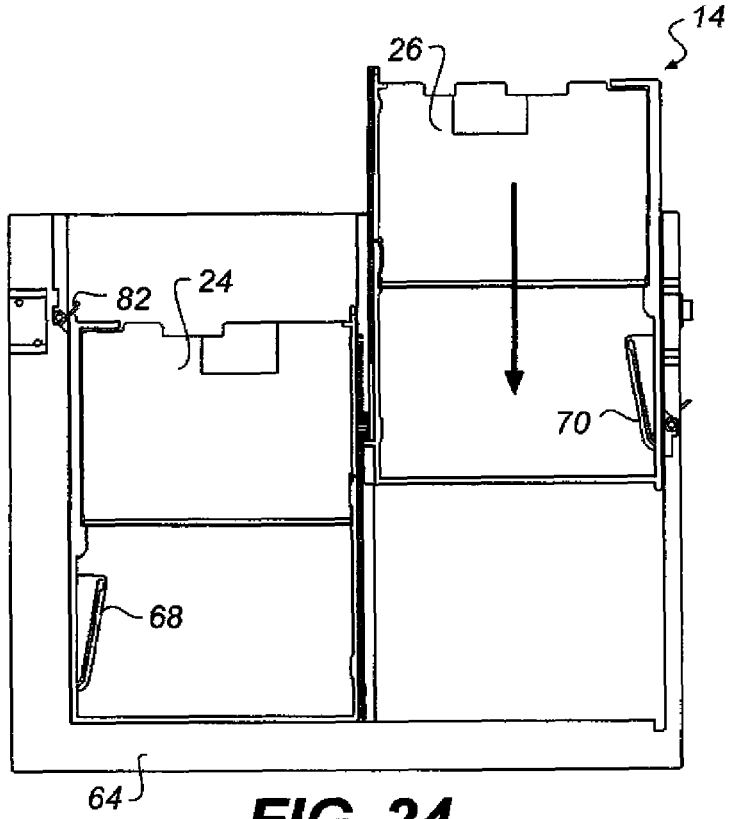

FIG. 22 illustrates the initial step of returning the sub trays to their media load positions. As left sub tray 24 moves in the direction of arrow 80 due to the reversal of pinion gear 66, its overlap tab feature 76 contacts overlap tab feature 74 of right sub tray 26 so that the right sub tray moves far enough to reengage its rack 43 with pinion gear 66. As left sub tray 24 reaches the end of engagement between its rack 43 and pinion gear 66, FIG. 23, the printer is ready to print the final page of an odd number multiple page print job. A biasing feature 82 pushes the tray a few more millimeters to fully disengage that rack and the pinion gear, FIG. 24. Right sub tray 26 continues to be driven by the pinion gear.

Figure 25:
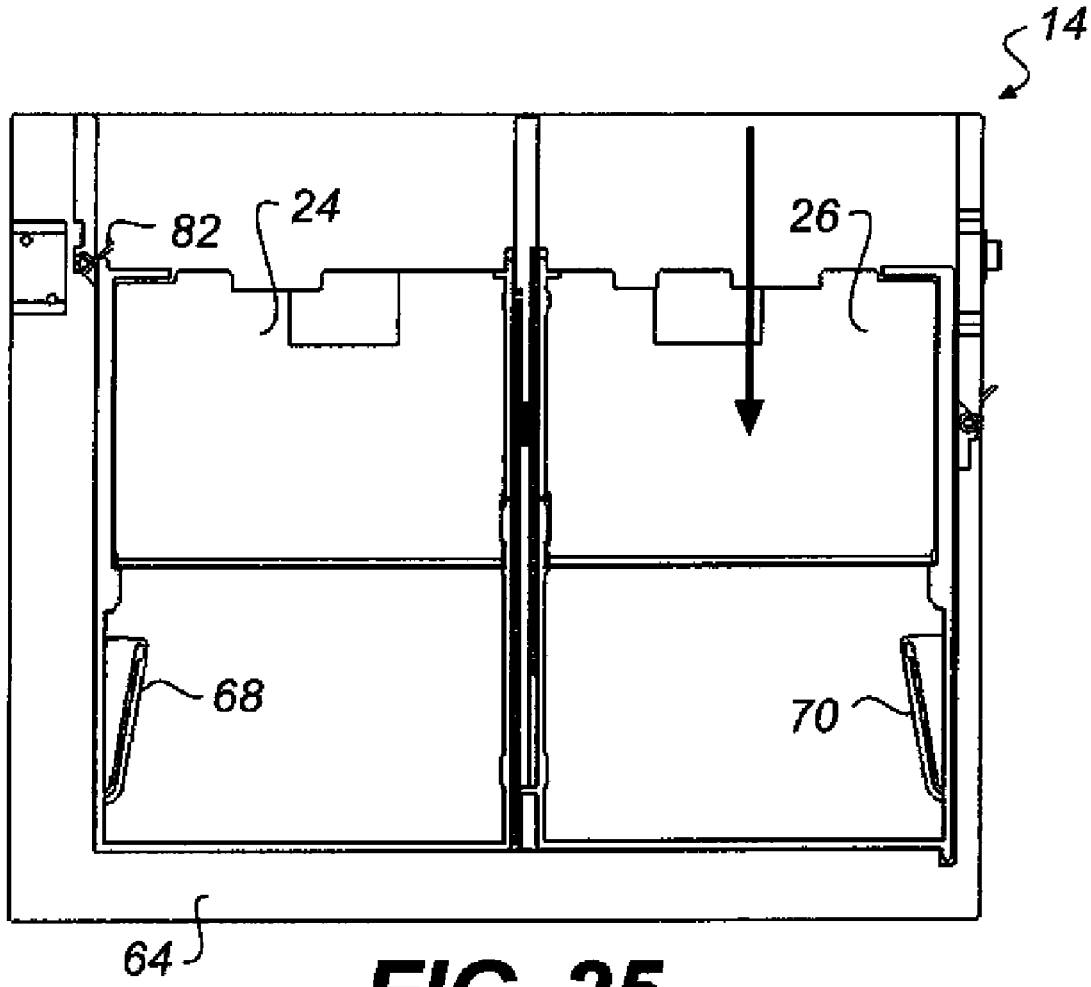

Right sub tray 26 continues to move back toward its media load position as shown in FIG. 25. The printer has finished the print job and is in its home position ready for media loading by end user. The unique advantage of having the trays move independently of each other is that in the event that a user prints an odd number of pages, the left sub tray will retract just before the final page is going to be printed so that only the right tray media will get picked. This prevents the situation whereby a blank piece of media gets picked and pushed through the entire media path. This improves the user's satisfaction by providing a truly clean and noninterfering method for printing an odd number of sheets.

The invention has been described in detail with particular reference to certain preferred embodiments thereof, but it will be understood that variations and modifications can be effected within the spirit and scope of the invention.

PARTS LIST

10. printer
12. main tray
14. auxiliary tray
16. left side wall
18. right side wall
20. left stack
22. right stack
24. left sub-tray
26. right sub tray
28. carriage
30. turn roller
32. feed roller
34. output roller
36. line feed motor
38. timing belt
40. arrow
42. rack
44. rocker gear transmission
46. rocker arm
48. output roller gear
50. transmission gear
52. idler roller
54. gear
56. gear shaft
58. transmission gear
60. pin
62. leaf spring
64. fixed tray support
66. pinion gear
68. left tray biasing spring
70. right tray biasing spring
72. direction
74. right overlap tab feature
76. left overlap tab feature
78. right biasing spring
80. arrow
82. biasing feature

The invention claimed is:

1. A printer comprising:

a marking mechanism for producing an image on media sheets;

first and second trays adapted to receive media sheets;

a sheet feeding mechanism with a drive for advancing media sheets past the marking mechanism, said sheet feeding mechanism having a picker to remove media sheets from trays;

a media load position for each of said first and second trays at which the trays are accessible to an operator for inserting a supply of media sheets;

a media pick position for each of said first and second trays at which the trays are aligned with the picker; and a mechanism adapted to selectively move each of said first and second trays between its media load position and its pick position, said trays being aligned side by side when both at their pick positions such that the picker can simultaneously remove a sheet from each tray.

2. A printer as set forth in claim 1 wherein the mechanism adapted to selectively move each tray is connectable independently to each tray so as to move one tray at a time from its media load position to its pick position such that the picker can remove a sheet from the first tray at the pick position before the second tray reaches the pick position.

3. A printer as set forth in claim 1 wherein the mechanism adapted to selectively move each tray is connectable independently to each tray so as to move one tray at a time from its pick position to its media load position such that the picker can remove a sheet from the tray remaining at the pick position after the other tray has been moved from the pick position.

4. A printer as set forth in claim 1 further comprising a transmission (1) engagable to connect the drive of the sheet feeding mechanism to the mechanism adapted to selectively move each tray whereby the trays are moved between their pick positions and their media load positions by the media sheet advancing drive and (2) disengagable to enable advancement of the media sheets without movement of the trays.

5. A printer as set forth in claim 4 wherein the transmission has a forward engagement state and a backwards engagement state such that each tray is moved in one direction when the transmission is in the forward engagement state and is moved in another direction when the transmission is in the backwards engagement state.

6. A printer as set forth in claim 1 wherein the mechanism adapted to selectively move each tray between the media load position and the pick position comprises a rack and pinion.

7. A printer as set forth in claim 6 wherein the mechanism adapted to selectively move each tray between the media load position and the pick position comprises a pinion driven by the sheet feeding mechanism and a rack associated with each tray, said pinion being independently engagable with and disengagable from each rack.

8. A method of producing an odd number of prints using a printer that has a marking mechanism, two trays adapted to receive media sheets, a sheet feeding mechanism with a drive for advancing media sheets past the marking mechanism, said sheet feeding mechanism having a picker to remove media sheets from trays, a media load position for each tray at which the tray is accessible to an operator for inserting a supply of media sheets, and a pick position for each tray at which the tray is aligned with the picker; said method comprising the steps of:

starting with both trays in their media load positions, moving one of the trays to its pick position;

moving the other of the trays to its pick position;

picking a sheet of media from each of said trays;

moving one of the trays to its media load position;

picking a sheet of media from the tray remaining at its pick position; and moving the tray remaining at its pick position from its pick position to its media load position.

* * * * *